US006050500A

United States Patent [19]

Ensworth

[11] Patent Number: 6,050,500

[45] Date of Patent: Apr. 18, 2000

[54] ADJUSTABLE RISER FOR AN IRRIGATION SPRINKLER

[75] Inventor: Mark M. Ensworth, Orange, Calif.

[73] Assignee: Anthony Manufacturing Corp. Industrial Products Division, Azusa, Calif.

[21] Appl. No.: 09/265,352

[22] Filed: Mar. 8, 1999

[51] Int. Cl.[7] ..... B05B 15/06

[52] U.S. Cl. ..... 239/203; 239/201; 239/206; 239/539; 285/302; 285/305

[58] Field of Search ..... 239/200, 201, 239/202, 203, 204, 205, 206, 539; 285/302, 305

[56] References Cited

U.S. PATENT DOCUMENTS

| | | | |
|---|---|---|---|
| 1,833,040 | 11/1931 | Rader | 239/203 X |
| 2,968,440 | 1/1961 | Cone | 239/203 |
| 3,083,914 | 4/1963 | Smith et al. | 239/203 |
| 3,317,144 | 5/1967 | Muschett | 239/204 |
| 4,099,670 | 7/1978 | Cole et al. | 239/205 |
| 4,274,592 | 6/1981 | Westhusin | 239/200 |
| 4,723,796 | 2/1988 | Nattel | 285/305 X |

*Primary Examiner*—Andres Kashnikow
*Assistant Examiner*—Robin O. Evans
*Attorney, Agent, or Firm*—Kelly Bauersfeld Lowry & Kelley, LLP

[57] ABSTRACT

An adjustable riser is provided for coupling an irrigation sprinkler to a water supply line, wherein the riser is adapted for quick and easy longitudinal adjustment to variably select the elevational position of the sprinkler relative to ground level. The adjustable riser comprises a pair of telescopically interfitting inner and outer riser tubes coupled respectively to the sprinkler and to the water supply line. The inner riser tube has a keyway formed on the exterior surface thereof, and the outer riser tube carries at least one key protruding into and engaged with the keyway. In the preferred form, the keyway comprises at least one recessed channel defined by an axially spaced succession of part-circumferential segments interconnected at opposite ends by axial segments extending in opposite directions. This channeled keyway permits longitudinal adjustment in riser length by displacement of the outer riser tube relative to the inner riser tube in a sequence of back and forth part-rotational steps with intervening axial steps, with the key tracking along the keyway to prevent full circle rotation of the outer riser tube relative to the inner riser tube.

19 Claims, 2 Drawing Sheets

ADJUSTABLE RISER FOR AN IRRIGATION SPRINKLER

BACKGROUND OF THE INVENTION

This invention relates generally to irrigation sprinkler systems of the type having one or more irrigation sprinklers coupled to a water supply line which is typically buried underground. More particularly, this invention relates to an improved and adjustable riser for coupling an irrigation sprinkler to a water supply line, wherein the riser permits the elevational position of the associated sprinkler to be adjusted quickly and easily to a selected height relative to the surrounding ground level.

Irrigation sprinkler systems are generally well known in the art, wherein a plurality of individual irrigation sprinkler heads or units are coupled with a water supply line to provide irrigation water to a selected terrain area, such as in a turf, golf, or agricultural irrigation environment. The water supply line is often buried underground, and is coupled by angled joints and vertically extending risers to the individual sprinkler units. The lengths of these risers are individually chosen to achieve partial or full exposure of the individual sprinkler units at a selected height relative to the ground level in accordance with the buried depth of the supply line as well as the type and height of the specific surrounding vegetation. Accordingly, when the irrigation system is initially installed, it is normally necessary to provide risers of several different lengths, or alternately to cut individual risers of custom lengths.

Over time, the ground level and the height of vegetation associated with an irrigation sprinkler system can change. That is, soil and organic matter can build up or erode from the vicinity of individual sprinkler units, to result in a need to adjust the elevational position of one or more sprinkler units. Moreover, vegetation such as shrubs and the like can grow significantly, or taller vegetation can be trimmed to a shorter height or otherwise replaced with shorter plants to result in a need to adjust the elevational position of one or more sprinkler units. In a typical irrigation system, such positional adjustment has required removal and replacement of risers, with at least some attendant digging to expose the buried water supply line in order to access and replace risers.

Adjustable riser arrangements have been proposed in an effort to permit vertical positional adjustment of sprinkler units without requiring riser removal or replacement. Such adjustable riser arrangements have included articulated riser assemblies having several swingably interconnected segments to accommodate vertical adjustment of a sprinkler unit attached thereto. See, for example, U.S. Pat. Nos. 5,040,729 and 5,242,112. These articulated riser assemblies, however, inherently utilize several component parts which undesirably increase system cost and further provide multiple potential water leakage sites between the movably interconnected components. Moreover, at least some digging is often required to at least partially expose the interconnected joint and riser segments in order to accommodate the desired vertical adjustment. In an alternative concept, elevational adjustment structures have been provided in the sprinkler unit, to permit vertical adjustment of a spray nozzle relative to the surrounding terrain. See, for example, U.S. Pat. No. 3,317,144. However, this approach undesirably increases the cost and complexity of each sprinkler unit, and further has not permitted bidirectional vertical adjustment in the absence of full circle rotation of at least part of the sprinkler unit. The requirement for full circle rotation to achieve elevational adjustment is especially undesirable in solenoid and hydraulically actuated sprinklers since it results respectively, in tangling of electrical wires connected to a solenoid actuator and may require disconnection of conduits connected to the hydraulic valve actuator.

The present invention is directed to an improved adjustable riser for coupling an irrigation sprinkler to a water supply line, wherein the elevational position of the sprinkler can be vertically raised or lowered quickly and easily without requiring full circle rotation of any component, and further without requiring any significant movement of soil in the vicinity of the sprinkler.

SUMMARY OF THE INVENTION

In accordance with the invention, an adjustable riser is provided for quickly and easily adjusting the elevational position of an irrigation sprinkler with respect to the surrounding ground level, and/or with respect to the height of surrounding vegetation to be irrigated. The riser comprises a pair of telescopically interfitting inner and outer riser tubes adapted for respective connection to the sprinkler and to a water supply line which may be buried underground. The telescopic riser tubes may be longitudinally adjusted relative to each other to extend or reduce the overall length of the riser, for adjustably setting the elevational position of the sprinkler.

In a preferred form, the inner riser tube has at least one and preferably a pair of keyways formed on the exterior surface thereof, and the outer riser tube carries at least one and preferably a pair of keys which respectively protrude into and engage the keyways. Each keyway comprises a channel defined by an axially spaced succession of part-circumferential segments interconnected at opposite ends by axial segments extending therefrom in opposite axial directions. The keyways permit longitudinal adjustment in riser length by displacement of the outer riser tube relative to the inner riser tube in a sequence of back and forth part-rotational steps with intervening axial steps, with the associated key on the outer riser tube tracking along the keyway to prevent separation of the riser tubes and further to prevent full circle rotation of the riser tubes with respect to each other. The keys may be provided in the form of a C-shaped retainer ring adapted for snap-fit mounting onto the outer riser tube, and including a pair of key teeth at opposite ends thereof to extend radially inwardly through a pair of radially open key slots formed in the outer riser tube for reception respectively into the keyways formed on the inner riser tube.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
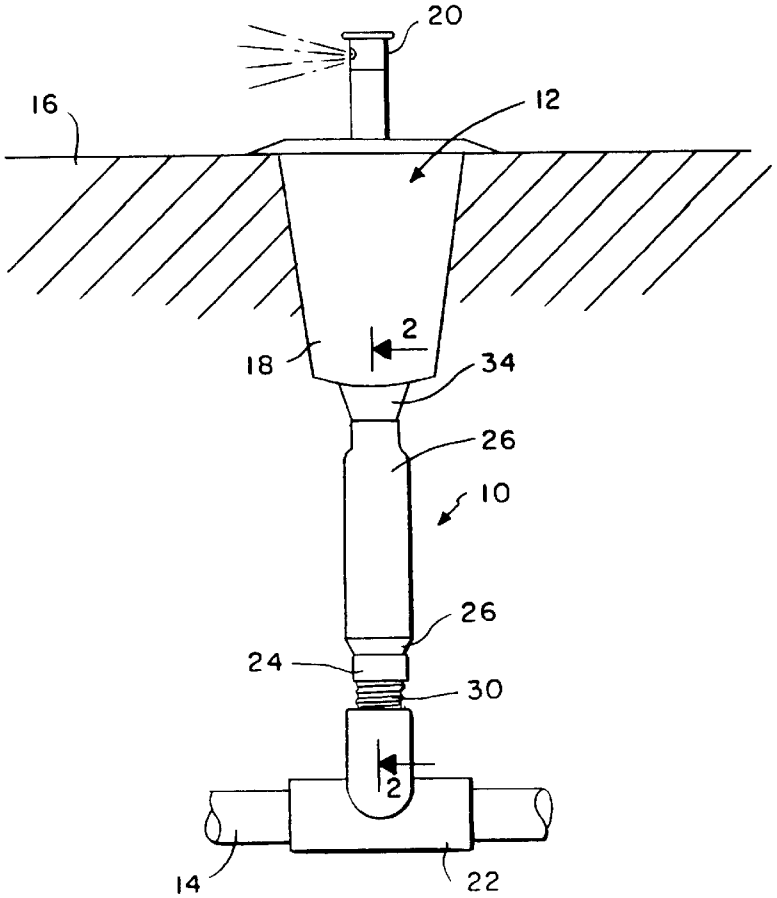
FIG. 1 is a fragmented front elevational view illustrating an adjustable riser constructed in accordance with the present invention for coupling an irrigation sprinkler to a water supply line.

As shown in the exemplary drawings, an adjustable riser referred to generally in FIG. 1 by the reference numeral 10 is provided for coupling an irrigation sprinkler 12 to a water supply line 14. The adjustable riser 10 permits quick and easy adjustment of the vertical elevational position of the sprinkler 12 relative to the surrounding ground level 16, and further with respect to the height of surrounding vegetation (not shown) to be irrigated. The riser 10 of the present invention permits such elevational sprinkler adjustment upwardly or downwardly without requiring any substantial or full circle rotation of the sprinkler 12, and further without requiring any significant digging into or other disruption of the soil.

FIG. 1 illustrates a typical irrigation sprinkler installation wherein the water supply line 14 is buried underground and comprises a conduit for flow of water under pressure to one or more sprinklers 12 connected thereto at selected locations to irrigate surrounding vegetation, such as grass, shrubs, agricultural plants, and the like. The riser 10 interconnects the water supply line 14 with the associated sprinkler 12 to vertically position the sprinkler 12 at a selected height relative to the surrounding ground level 16, and/or with respect to the height of surrounding vegetation. As shown, the riser 10 has an upper end coupled to the lower end of a sprinkler housing or case 18 within which a pop-up type sprinkler head or spray nozzle 20 is mounted. A lower end of the riser 10 is shown coupled to a tee fitting 22 mounted in-line along the length of the water supply line 14.

Figure 2:
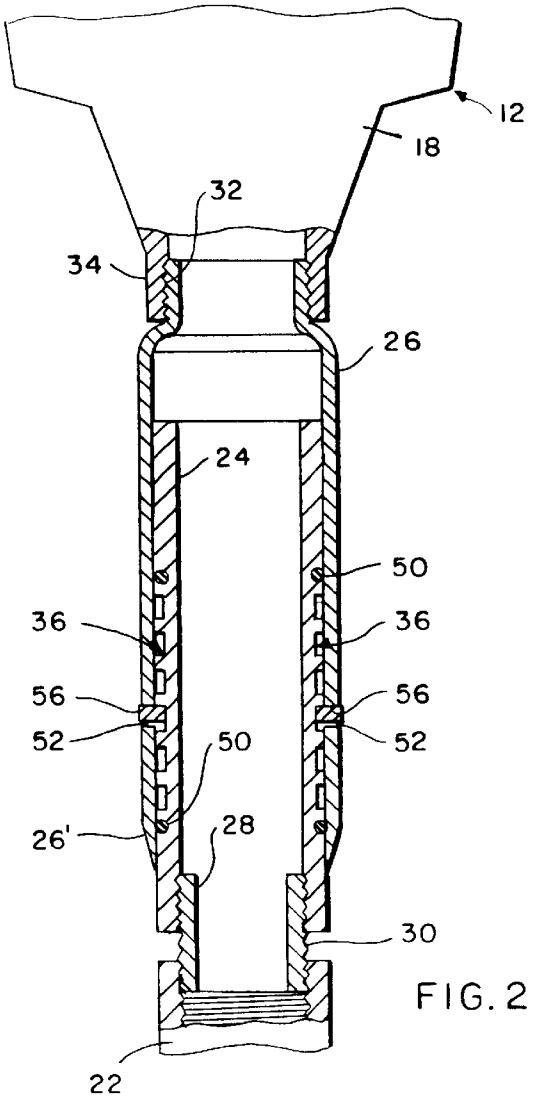
FIG. 2 is an enlarged and fragmented vertical sectional view taken generally on the line 2—2 of FIG. 1.

As shown in more detail in FIG. 2, the riser 10 comprises a pair of telescopically interfitting inner and outer riser tubes 24 and 26. The inner riser tube 24 has a first or lower free end defining an internally threaded segment 28 for connection by means of a short threaded nipple 30 or the like to the tee fitting 22. From this threaded segment 28, the inner riser tube 24 extends upwardly with a sliding concentric fit into the interior of the outer riser tube 26, the upper or free end of which is shown necked down and externally threaded to define a threaded fitting 32 for connection into a mating threaded fitting 34 at the lower end of the sprinkler case 18.

Figures 3, 4:
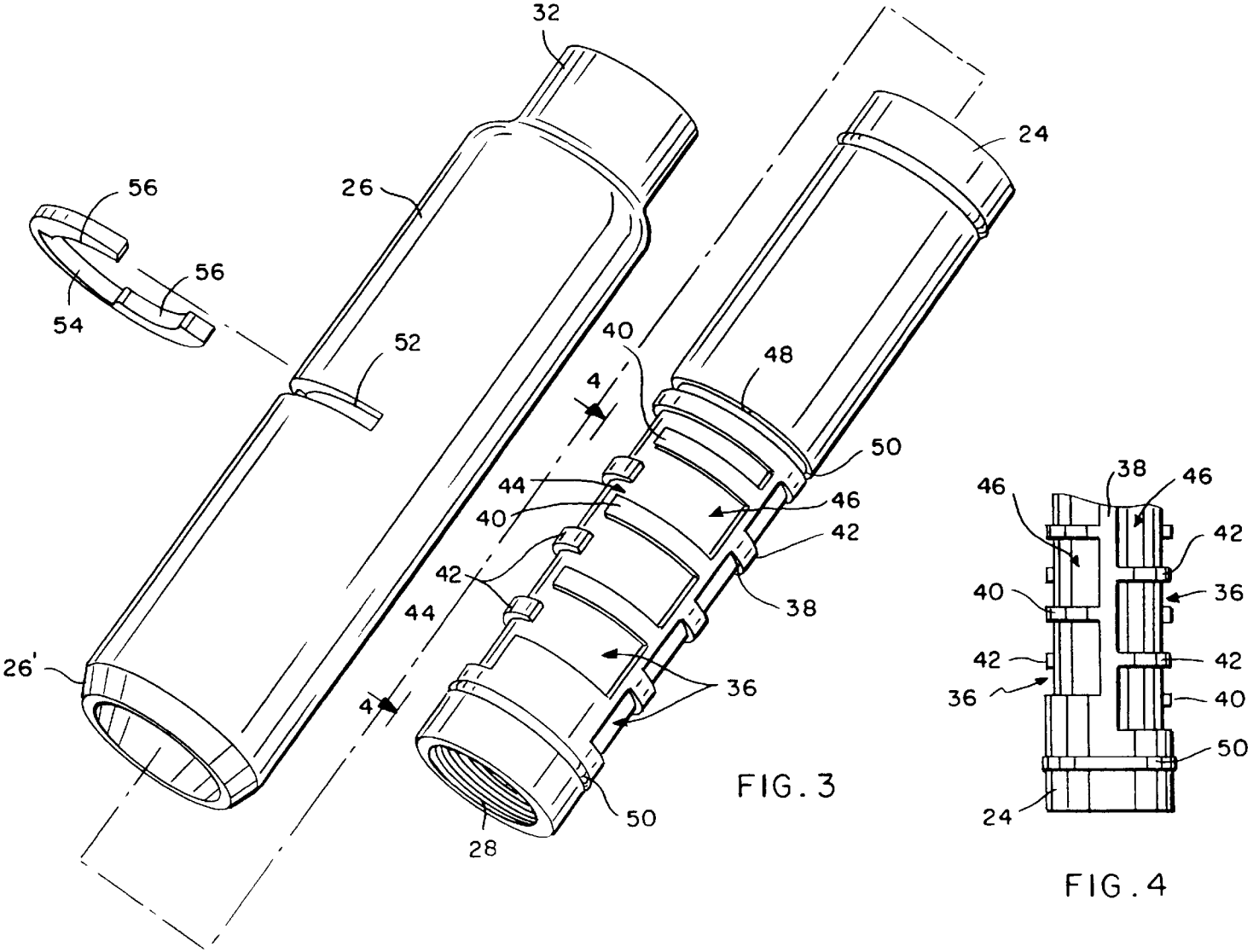
FIG. 3 is an exploded perspective view depicting components of the adjustable riser.
FIG. 4 is a fragmented side elevation view of an inner riser tube forming a portion of the adjustable riser, taken generally on the line 4—4 of FIG. 3.

The exterior surface of the inner riser tube 24 has at least one and preferably a pair of channeled keyways 36 formed therein. As shown best in FIGS. 3 and 4, each keyway 36 comprises a recessed channel defined between a pair of longitudinally or axially extending side walls 38, wherein these side walls 38 are shown at diametrically opposed locations separated by a part-circumferential arc of about 180°. A plurality of part-circumferential ribs 40 and 42 extend from the two side walls 38 toward each other in an axially staggered pattern, terminating in free ends disposed approximately mid-way between the two side walls 38. These ribs 40 and 42 cooperate with the side walls 38 to subdivide the recessed channel into an axially spaced succession of part-circumferential channel segments 44 which are interconnected at their opposite ends by axial channel segments 46 extending in opposite longitudinal or axial directions therefrom. In the preferred form, this keyway geometry is replicated by additional part-circumferential ribs 40 and 42 extending from the side walls 38 toward each other in the same axially staggered pattern on the opposite exterior side of the inner riser tube 24 (FIG. 4). A pair of annular seal ring grooves 48 are formed in the inner riser tube 24 respectively at the opposite longitudinal ends of the keyways 36 for receiving and supporting a pair of O-ring seals 50 or the like.

The outer riser tube 26 comprises a cylindrical sleeve having a size and shape for slide-fit reception of the inner riser tube 24, with an inner diameter surface sized for substantially sealed sliding engagement with the O-ring seals 50. A pair of arcuate, radially open and part-circumferential slots 52 (FIGS. 2 and 3) are formed in the outer riser tube 26 at a selected axial location to accommodate snap-fit mounting of a generally C-shaped retainer ring 54 having a pair of inwardly radiating keys 56 formed at the opposite free ends thereof. When the retainer ring 54 is snap-fitted onto the outer riser tube 26, the keys 56 protrude radially inwardly through the slots 52 and further radially inwardly into the keyways 36 formed on the opposite sides of the inner riser tube 24. Accordingly, the retainer ring 54 secures the outer riser tube 26 onto the inner riser tube 24 in a manner constraining relative motion between the riser tubes 24, 26 to guided travel of the keys 56 along the keyways 36.

With this construction, subsequent to use of the riser 10 to connect the sprinkler 12 to the underground water supply line 14, the riser 10 can be longitudinally adjusted quickly and easily to variably select the vertical elevation of the sprinkler 12 relative to the surrounding ground level 16. Such longitudinal adjustment is performed by grasping the sprinkler 12 and/or the outer riser tube 26, and then moving these components through a succession of back and forth part-rotational steps of about 90° each, with intermediate axial displacement steps. This movement displaces the keys 56 carried by the outer riser tube 26 through a part-rotational step in one direction along one of the part-circumferential keyway segments 44, followed by short axial displacement along the adjacent axial keyway segment 46 to increase or decrease the effective length of the riser 10, followed in turn by return rotation through a part-rotational step in an opposite direction with the keys 56 tracking along the succeeding part-circumferential keyway segment 44. This adjustment in riser length can normally be accomplished quickly and easily with little or no disruption of the soil. In this regard, a lower marginal segment 26' (FIGS. 1–3) of the outer riser tube 26 is conveniently tapered downwardly and radially inwardly to define a relatively sharp edge suitable for downward displacement as needed without significant soil disruption and without requiring any digging. Moreover, length adjustment of the riser 10 does not require full circle rotation of any sprinkler or riser component, wherein such full circle rotation would be especially undesirable with a sprinkler of the type having a solenoid actuator and would entangle conductor wires coupled to the solenoid actuator.

In an alternative method of adjustment, the retainer ring 54 can be temporarily removed from the outer riser tube 26, to permit substantially free and unobstructed longitudinal adjustment of the outer riser tube 26 up or down, as desired. In this configuration, this adjustment to increase or decrease the overall length of the riser 10 can be performed with little or no relative rotation between the inner and outer riser tubes 24, 26. When the selected riser length is achieved, the retainer ring 54 can be re-installed onto the outer riser tube 26 to re-lock the components relative to each other.

The adjustable riser 10 of the present invention thus permits rapid variable adjustment of the elevational position of a sprinkler 12 without requiring significant digging into the soil, and further without requiring any significant rotation of sprinkler components or disassembly of sprinkler components. Accordingly, the height of the sprinkler can be initially set during system installation, and thereafter changed on an as-needed basis to accommodate changing ground level conditions or changes in the height or type of vegetation to be irrigated.

A variety of further modifications and improvements in and to the adjustable riser of the present invention will be apparent to those persons skilled in the art. For example, while the invention has been shown and described with the outer riser tube 26 coupled to the associated sprinkler 12, it will be recognized and understood that the adjustable riser may be installed in an inverted orientation, if desired. Accordingly, no limitation on the invention is intended by way of the foregoing description and accompanying drawings, except as set forth in the appended claims.

What is claimed is:

1. An adjustable riser for connecting an irrigation sprinkler to a water supply line, said riser comprising:

first and second telescopically interfitting riser tubes adapted for connection respectively to an irrigation sprinkler and to a water supply line;

said first riser tube having a keyway formed thereon; and a key carried by said second riser tube to protrude into and engage said keyway on said first riser tube, said key and said keyway cooperatively permitting bidirectional longitudinal adjustment in the position of said first and second riser tubes relative to each other without requiring full circle rotation therebetween.

2. The adjustable riser of claim 1 wherein said keyway on said first riser tube comprises a channel defined by an axially spaced succession of part-circumferential segments interconnected at opposite ends by axial segments extending therefrom in opposite longitudinal directions, whereby the longitudinal length of the riser is adjustable by displacing said second riser tube relative to said first riser tube in a sequence of back and forth part-rotational steps with intervening axial steps.

3. The adjustable riser of claim 1 wherein said first riser tube comprises an inner riser tube, and wherein said second riser tube comprises an outer riser tube.

4. The adjustable riser of claim 3 further including a retainer ring mounted on said outer riser tube, said retainer ring having said key formed thereon extending through a slot formed in said outer riser tube to protrude into and engage said keyway formed on said inner riser tube.

5. The adjustable riser of claim 4 wherein said retainer ring is removably mounted on said outer riser tube.

6. The adjustable riser of claim 1 further including seal means carried by said first riser tube generally at opposite longitudinal ends of said keyway for substantially sealed sliding engagement with said second riser tube.

7. The adjustable riser of claim 1 wherein said first and second riser tubes each include a free end having a threaded fitting thereon.

8. An adjustable riser for connecting an irrigation sprinkler to a water supply line, said riser comprising:

first and second telescopically interfitting riser tubes adapted for connection respectively to a water supply line and to an irrigation sprinkler;

said first riser tube having at least one keyway formed thereon, and at least one key carried by said second riser tube to protrude into and engage said keyway on said first riser tube;

said keyway on said first riser tube comprising a channel defined by an axially spaced succession of part-circumferential segments interconnected at opposite ends by axial segments extending therefrom in opposite longitudinal directions, whereby the longitudinal length of the riser is adjustable by displacing said second riser tube relative to said first riser tube in a sequence of back and forth part-rotational steps with intervening axial steps, without requiring full circle rotation therebetween.

9. The adjustable riser of claim 8 wherein said first riser tube comprises an inner riser tube, and wherein said second riser tube comprises an outer riser tube.

10. The adjustable riser of claim 9 wherein said outer riser tube has an upper end adapted for connection to the irrigation sprinkler, and a lower end telescopically received over said inner riser tube, said lower end terminating in a downwardly and radially inwardly tapered segment.

11. The adjustable riser of claim 9 further including a retainer ring mounted on said outer riser tube, said retainer ring having said key formed thereon extending through a slot formed in said outer riser tube to protrude into and engage said keyway formed on said inner riser tube.

12. The adjustable riser of claim 11 wherein said retainer ring is removably mounted on said outer riser tube.

13. The adjustable riser of claim 8 further including seal means carried by said first riser tube generally at opposite longitudinal ends of said keyway for substantially sealed sliding engagement with said second riser tube.

14. The adjustable riser of claim 8 wherein said at least one keyway comprises a pair of said keyways formed on said first riser tube, and wherein said at least one key comprises a pair of said keys carried by said second riser tube respectively to protrude into and engage said pair of keyways on said first riser tube.

15. The adjustable riser of claim 14 wherein said first riser tube comprises an inner riser tube, and wherein said second riser tube comprises an outer riser tube, and further including a generally C-shaped retainer ring mounted on said outer riser tube, said retainer ring having said pair of keys formed thereon generally at the free ends thereof and extending respectively through a pair of slots formed in said outer riser tube respectively to protrude into and engage said pair of keyways formed on said inner riser tube.

16. The adjustable riser of claim 15 wherein said retainer ring is removably mounted on said outer riser tube.

17. An adjustable riser for connecting an irrigation sprinkler to a water supply line, said riser comprising:

inner and outer telescopically interfitting riser tubes adapted for connection respectively to an irrigation sprinkler and to a water supply line;

said inner riser tube having a keyway formed thereon; and a key removably mounted on said outer riser tube to protrude into and engage said keyway on said inner riser tube for retaining said inner and outer riser tubes in a selected position of longitudinal adjustment, said inner and outer riser tubes being bidirectionally longitudinally adjustable relative to each other without requiring full circle rotation therebetween.

18. The adjustable riser of claim 17 wherein said keyway on said inner riser tube comprises a channel defined by an axially spaced succession of part-circumferential segments interconnected at opposite ends by axial segments extending therefrom in opposite longitudinal directions, whereby the longitudinal length of the riser is adjustable without removal of said key from said outer riser tube by displacing said outer riser tube relative to said inner riser tube in a sequence of back and forth part-rotational steps with intervening axial steps.

19. The adjustable riser of claim 17 further including a retainer ring mounted on said outer riser tube, said retainer ring having said key formed thereon extending through a slot formed in said outer riser tube to protrude into and engage said keyway formed on said inner riser tube.

* * * * *